United States Patent [19]

Jouret

[11] 4,294,501

[45] Oct. 13, 1981

[54] PLUG MEMBER FOR THE ELECTRICAL CONNECTION OF AN APPLIANCE TO A BASE

[75] Inventor: Edouard Jouret, Bresso-Milano, Italy

[73] Assignee: Crouzet, Paris, France

[21] Appl. No.: 97,428

[22] Filed: Nov. 26, 1979

[30] Foreign Application Priority Data

Dec. 1, 1978 [FR] France ..... 78 34162

[51] Int. Cl.[3] ..... H01R 13/639

[52] U.S. Cl. ..... 339/66 M; 339/75 M

[58] Field of Search ..... 339/69, 70, 71, 72, 339/75 R, 75 M, 75 T, 75 P, 91 R, 91 L, 91 F, 91 P, 92 R, 92 M, 65, 66 R, 66 M, 66 T

[56] References Cited

U.S. PATENT DOCUMENTS

| | | | |
|---|---|---|---|
| 1,337,422 | 4/1920 | Whelpley et al. | 339/71 |
| 1,915,344 | 6/1933 | Wolfe | 339/72 |
| 3,040,285 | 6/1962 | Stanley | 339/177 L |
| 3,646,501 | 2/1972 | Valtonen | 339/75 M |
| 4,083,619 | 4/1978 | McCormick et al. | 339/75 M |

*Primary Examiner*—Neil Abrams

*Attorney, Agent, or Firm*—Holman & Stern

[57] ABSTRACT

A plug member for the electrical connection of an appliance to a base. The plug member comprises conducting pins, an insulating centering stud and means for locking the plug member on the base. The centering stud is open laterally. The locking means are disposed in the centering stud for projecting therefrom to engage the wall of a centering hole in the base.

4 Claims, 2 Drawing Figures

PLUG MEMBER FOR THE ELECTRICAL CONNECTION OF AN APPLIANCE TO A BASE

BRIEF SUMMARY OF THE INVENTION

The present invention relates to a plug member for the electrical connection of an appliance to a base, or receptacle member, comprising conducting pins, an insulating centering stud adapted to be introduced into a centering hole in the base, and means for locking the plug member on the base.

The conducting pins of the plug member are generally disposed in an arc around the centering stud, of which the first function is precisely to correctly position the plug member on the base so that the conducting pins are easily introduced in the corresponding holes in the base.

In the majority of known plug members, the plug member is held on the base by tightening the conducting pins of the plug member in the corresponding holes in the base.

U.S. Pat. No. 4,083,619 describes a plug member of the type mentioned hereinabove, in which a device is provided for locking the plug member on the base. The said plug member already constitutes an improvement, the centering stud performing a second function of locking. In this plug member, the centering stud is mobile and itself ensures the locking of the plug member-base assembly, by means of locking fingers integrally formed with the stud and which may be spaced apart by a suitable, but complicated mechanism. The locking of this plug member on the base is consequently a complex operation.

It is an object of the present invention to provide a plug member with simple locking action.

To this end, the invention relates to a plug member of the type mentioned hereinabove, wherein the centering stud is open laterally and the locking means are disposed in the centering stud and arranged to project from the centering stud and thus to engage the wall of the centering hole in the base.

In a preferred embodiment of the plug member of the invention, the locking means comprise a U-shaped piece, whose arms may be spread apart, under the action of two inclined planes, to project from the stud when the U-piece is driven in translation by an eccentric carried on a shaft perpendicular to the direction of displacement of the U. The simplicity of this embodiment is quite outstanding.

The invention will be more readily understood on reading the following description with reference to the accompanying drawings.

DETAILED DESCRIPTION

Figure 1:
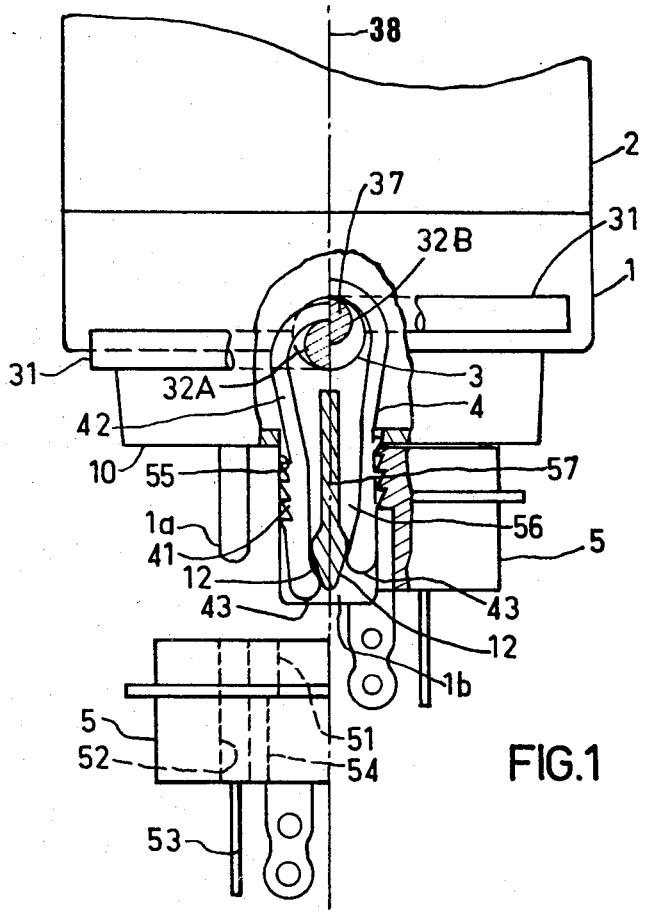
FIG. 1 is a view in partial vertical section, illustrating, in the left-hand part, the plug member not plugged into the base and, in the right-hand part, the plug member plugged in and locked on the base.
Figure 2:
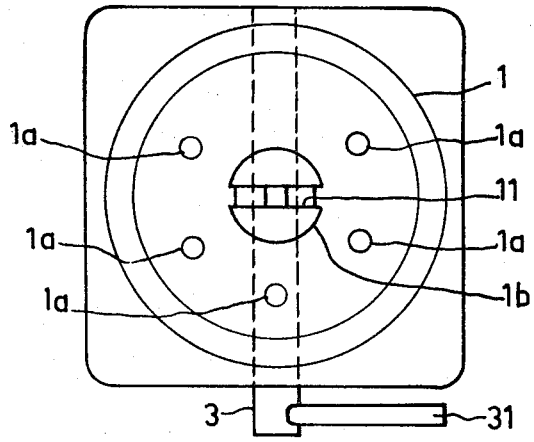
FIG. 2 is a bottom view, on a smaller scale, of the plug member of FIG. 1.

Referring now to the drawings, FIG. 1 shows a plug member 1 of an electrical appliance 2, comprising conducting pins 1*a* disposed in an arc around an insulating centering stud 1*b*, the pins and the stud extending perpendicularly to the surface 10 of the plug member in contact with a base described hereinafter.

The base, or receptacle member, 5 in question, shown partly in FIG. 1, comprises metal-sheathed holes 52 connected to terminals 53, and a centering hole 51, adapted to receive the pins 1*a* and the centering stud 1*b*, respectively. The centering hole 51, whose diameter is substantially equal to that of the stud 1*b*, extends only over a part of the thickness of the base and is prolonged by a bore 54 of larger diameter to offer, in the base, a through space for the stud of the plug member.

The centering stud 1*b*, which is preferably obtained by moulding an insulating material, is laterally open on two diametrically opposite sides to present, approximately over half the length of the stud, two windows 55 through which the locking means described hereinafter may cooperate with the wall of the bore 51 of the base.

Furthermore, the stud 1*b* has an annular space 56 providing a zone of matter 57 comprising two planes 12 inclined in opposite directions on the median plane 38 of the plug member, towards the outside and towards the body 1 of the plug member, and extending, from subtantially the open end of the stud 1*b*, over a distance clearly shorter than half the length of the stud.

The means for locking the plug member on the base comprise a U-shaped piece 4, preferably made of metal, disposed in the stud 1*b*, and open towards the end of the stud, and of which the arms 42 are housed in the annular space 56 on either side of the zone 57. The arms 42 each possess, at their end, a slight swell 43 adapted to cooperate with an inclined plane 12 of the zone 57. The arms 42 of the U-piece are provided, substantially opposite the windows 55 of the stud, with locking teeth 41. In the unlocked position, enlarged ends 43 on piece 4 are in contact with the thinnest part of the active inclined plane zone, so that the arms of the U-shaped piece 4, which are relatively elastic, are in their rest position and close to each other. In this position, the teeth 41 of the arms 42 do not project from the windows 55 of the centering stud of the plug member. The locking means further comprise a pivot shaft 3, rotatably mounted in the body of the plug member, in its median plane 38, about an axis perpendicular to the stud 1*b*. The pivot shaft 3 carries an eccentric 32. The pivot 3, with its eccentric 32, may be rotated through 180° by means of a lever 31, extending perpendicularly to the pivot 3, to displace the eccentric from a locked position illustrated at 32B on the right hand side of FIG. 1, to an unlocked position illustrated at 32A in the left-hand part of FIG. 1, and vice versa.

The U-piece is force fitted on the eccentric 32, the central part of the piece 4 located between the arms 42 thus being fast with the eccentric 32.

The functioning of the device for locking the plug member described hereinabove will now be given.

As has just been described hereinabove, the U-shaped piece 4 is mounted in the plug member and the stud to be driven in translation parallel to stud 1*b*.

When the eccentric 32 occupies the unlocked position 32A, the arms of the piece 4 are not spread apart and the teeth 41 do not project from the windows 55. The plug member 1 may then be plugged in or removed from the base 5. After plugging in, the pins 1*a* and the stud 1*b* of the plug member 1 being housed respectively in the holes 52 and (51,54) in the base, the lever 31 is rotated to turn the pivot 3 with its eccentric 32. The eccentric passes from position 32A to position 32B and drives piece 4 inwardly in translation. During this movement of translation, the enlarged ends 43 of the arms 42 ride on the inclined planes 12 and thus move apart from one another, due to which, when the eccentric 32 occupies its locked position 32B, the teeth 41 of the arms 42 project from the windows 55 of the stud 1*b* and are applied against the wall of the hole 51 in the base 5. In this position, the plug member 1 is locked on the base 5, and the electrical connection of the appliance 2 is thus effected.

What I claim is:

1. In an electrical connector including a plug member and a base having conducting pins extending from the plug to be introduced into metal-sheathed holes in the base for electrically connecting the plug to the base, a centering stud adapted to be introduced in a centering hole in the base, and locking means for locking the plug member on the base, the improvement wherein the locking means comprises a hollow recess in said stud, at least two lateral openings through said stud between said recess and the outer surface of said stud, a U-shaped locking member mounted within said recess for sliding movement with respect to said stud between a locking and a release position, means in said recess for spreading apart the arms of the U-shaped locking member as it moves from said release to said locking position so that said arms project from the centering stud through said lateral openings to engage the wall of the centering hole in the base, and means on said plug to move said locking member between said release and locking positions.

2. A plug member as claimed in claim 1, wherein the open end of said U-shaped locking member is adjacent the outer end of the centering stud.

3. A plug member as claimed in claim 2, wherein said spreading means comprises a wedge member fixed to said plug and having two inclined planes disposed in said recess to cooperate with the ends of the arms of said U-shaped locking member, and said means to move said locking member comprises a shaft rotatably mounted in said plug to rotate about an axis perpendicular to the direction of movement of said U-shaped locking member, an eccentric on said shaft in cooperating engagement with the closed end of said locking member between said arms to move said locking member between said positions when said shaft is rotated, and a handle external to said plug in engagement with said shaft to rotate said shaft to selectively lock or release said plug.

4. A plug member as claimed in any one of claims 1, 2, or 3, wherein said arms of the U-shaped locking member are provided with locking teeth on their outer surfaces which engage the wall of said centering hole.

* * * * *